US006110850A

United States Patent [19]

Thurner

[11] Patent Number: 6,110,850

[45] Date of Patent: Aug. 29, 2000

[54] FABRIC

[75] Inventor: Albert Thurner, Innsbruck, Austria

[73] Assignee: Tiroler Loden GmbH, Innsbruck, Austria

[21] Appl. No.: 08/933,092

[22] Filed: Sep. 18, 1997

[30] Foreign Application Priority Data

Sep. 18, 1996 [AT] Austria ..... 1651/96

[51] Int. Cl.[7] ..... D04H 3/14

[52] U.S. Cl. ..... 442/409; 139/405; 139/408; 139/409; 139/410; 139/413; 139/414; 428/116; 442/205; 442/209; 442/211; 442/239; 442/246

[58] Field of Search ..... 139/408, 409, 139/410, 413, 414, 405; 442/209, 211, 205, 239, 246; 428/116

[56] References Cited

U.S. PATENT DOCUMENTS

| | | | |
|---|---|---|---|
| 4,945,952 | 8/1990 | Vohringer | 139/383 A |
| 4,974,642 | 12/1990 | Taipale | 139/383 A |
| 5,052,448 | 10/1991 | Givin | 139/383 A |
| 5,219,004 | 6/1993 | Chiu | 139/383 A |

FOREIGN PATENT DOCUMENTS

| | | |
|---|---|---|
| 1076928 | 5/1980 | Canada . |
| 0 144 530 | 6/1985 | European Pat. Off. . |
| 43 01 501 | 10/1993 | Germany . |
| 93 15 978 | 4/1994 | Germany . |

*Primary Examiner*—Jenna Davis
*Assistant Examiner*—Ula C Ruddock
*Attorney, Agent, or Firm*—Jacobson, Price, Holman & Stern, PLLC

[57] ABSTRACT

The invention relates to a fabric for the production of clothing from at least two different threads. For the creation of such a fabric, which has on one side substantially the properties determined by one thread and on the other side substantially the properties determined by the other thread or threads and has from each side substantially the visual appearance of a homogeneous fabric, according to the invention the fabric consists of an upper fabric and a lower fabric, the upper fabric being formed exclusively from one thread and the lower fabric exclusively from the other thread or threads, while the upper fabric is connected to the lower fabric by the attachment in places of individual threads of the lower fabric to threads of the side of the upper fabric adjacent the lower fabric, or the upper side of the fabric is formed mainly from one thread and the lower side of the fabric is formed mainly from the other thread or threads.

16 Claims, 8 Drawing Sheets

FABRIC

Figure 1:
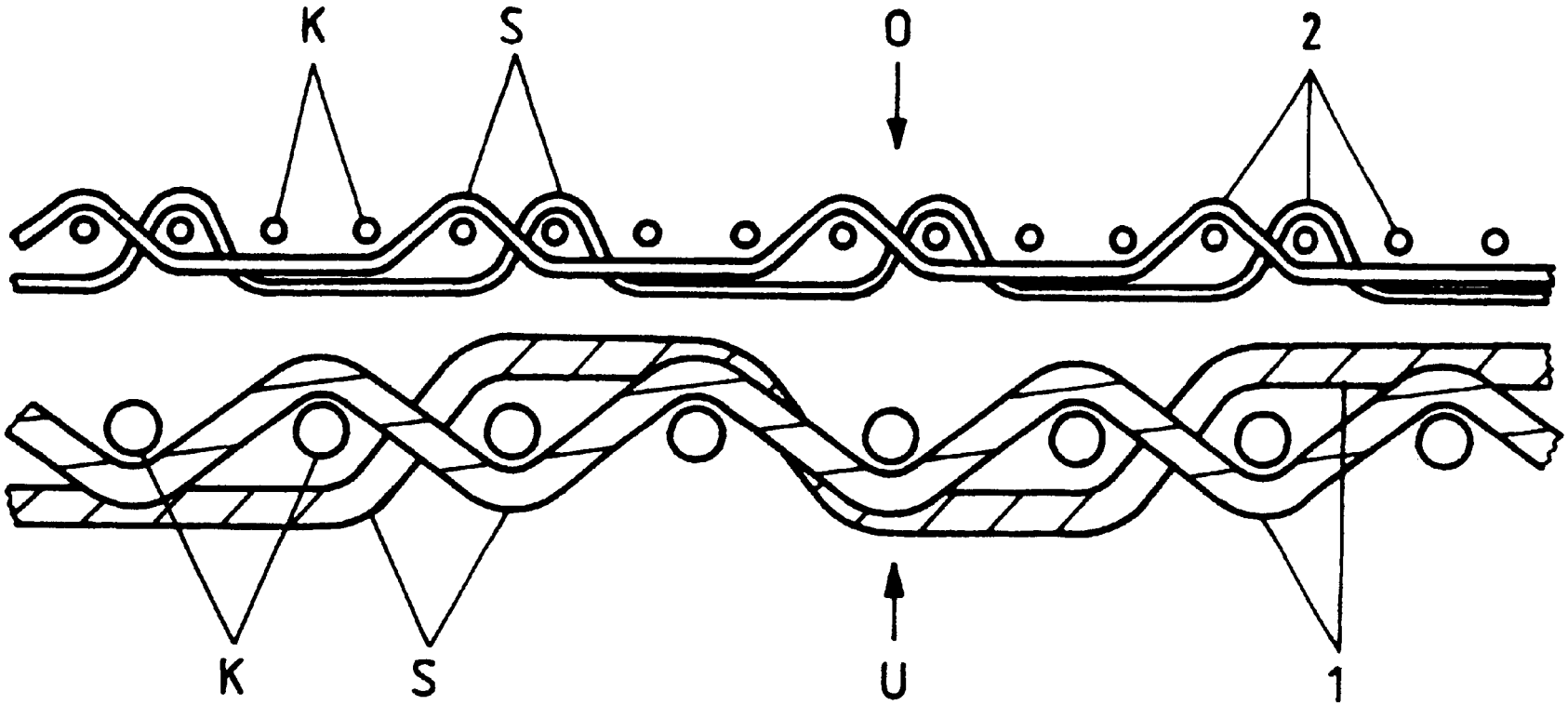

The invention relates to a fabric for the production of clothing from at least two different threads and also to a method of producing a fabric of the kind specified.

Double fabrics (so-called double materials) are known for the purpose of obtaining different properties on the two sides of a material. Such a material, garment or the like produced therefrom, can be turned to alter its appearance or properties. For example, one side of the double material can be made from a smooth material for the side close to the body, a rough material to prevent it from slipping if used as a cover, or a water-impermeable material of one side of a garment or the like which is turned away from the body and exposed to weather. The same effect can be achieved by two different materials which are connected to one another by sewing, gluing or the like. However, in the case of sewing, the visible sewing thread spoils the appearance of the fabric and moreover the connection may easily be loosened if the sewing thread is damaged. Gluing has a disadvantageous effect on the properties of the fabric, which may lose softness as a result. The further processability of the material can also be adversely effected thereby. An adhesive may also have an unfavourable effect on air permeability if the material is used for a garment.

It is an object of the invention to obviate the aforementioned disadvantages by providing a fabric for the production of clothing from at least two different threads which has on one side substantially the properties determined by one thread and on the other side substantially properties determined by the other thread or threads. When viewed from at least one side, the fabric has the visual appearance of a substantially homogeneous fabric—i.e. one consisting of only one type of thread.

This problem is solved according to the invention by the features that the fabric consists of an upper fabric and a lower fabric, the upper fabric being formed exclusively from one thread and the lower fabric exclusively from the other thread or threads, while the upper fabric is connected to the lower fabric by the attachment in places of individual threads of the lower fabric to the side of the upper fabric adjacent the lower fabric. Both the upper fabric and the lower fabric act like a single fabric with its properties. At the same time, the upper fabric is connected to the lower fabric without the use of ancillary means.

The problem is also solved according to the invention by the feature that the upper side of the fabric is formed mainly from one thread and the lower side of the fabric is formed mainly from the other thread or threads. This kind of fabric has the same advantages as a fabric set forth in the preceding paragraph. Since the two sides of the fabric each consist mainly of the different threads, the properties of the two sides of the fabric also differ in accordance with the threads used.

Advantageously, the upper side of the fabric consists of at least 90%, preferably 99.3% of one thread and the lower side of the fabric consists of 90%, preferably 99.3% of the other thread or threads. As a result, a look at the two sides of the fabric gives the visual impression that two different superimposed materials are involved.

Different visual effects can be obtained on the two sides of the fabric if the threads have different colours.

A fabric with differentially smooth sides can be obtained by the selection of threads of different thicknesses.

If the threads are of different materials, the particular properties of the materials used can be transmitted to the particular side of the fabric. As a result, different fabric properties can be achieved on the front and rear sides of the fabric. If the material for the inside of the fabric is suitably selected, it can at the same time act as a lining, so that no special lining material must be sewn in for the production of garments.

Advantageously, one thread consists mainly of wool and the other thread or threads consist mainly of cotton. The result is a combination of the favourable properties of shorn wool in respect of resistance to change in temperature and wind-proof qualities with the favourable properties of cotton in respect of smoothness, wearing comfort and breathing activity. The woollen side of the fabric is therefore advantageously used for the outside of the material and the cotton side of the fabric for the side of the material close to the body. Of course, in the other materials such as, for example, silk or synthetic fibres can be used for the smooth side of the fabric and different combinations are conceivable.

Particular advantages are obtained if the upper fabric/upper side of the fabric formed by the wool thread is an unfulled wool cloth (loden) or a loden-like fabric. In this way it is possible to combine the properties of the loden with the properties of cotton. The elaborate processing of shorn wool, namely fulling, makes the loden not only warmer and stronger, but also extremely water-repellent. Loden consists of 100% shorn wool and is particularly resistant to tearing and protects against cold. Garments made from loden guarantee optimum wearing comfort, hence the structuring of this kind of material causes a heat exchange and breathing activity is created. From the outside such a fabric looks like a loden or loden-like material, while the advantages of the smooth cotton come into effect on the side of the material close to the body. As far as possible no hairs of the wool material could penetrate to the side of the cotton material, so that the fabric cannot be scratchy and the material offers optimum wearing properties. It is a characteristic of loden that the structure of the fabric is not visible. A garment produced from such a material therefore combines the advantages of the heat-storing and weather-resistant loden on the outside with the skin-friendly wearing properties of cotton on the inside.

If the lower fabric/lower side of the material is denser than the upper fabric/upper side of the material, this also prevents, for example, the coarse wool threads of the upper fabric/upper side of the material being able to penetrate through, for example, the lower fabric/lower side of the material made from cotton threads, which would otherwise spoil the smooth structure of the cotton fabric.

It is another object of the invention to provide a method of producing the fabric according to the invention which permits rapid, and more particularly, economic manufacture.

The problem of producing a fabric consisting of an upper fabric and a lower fabric connected thereto as disclosed in the foregoing description is solved by the feature that the fabric is produced in a single weaving operation from at least two different threads. As a result, the upper fabric can be securely connected to the lower fabric during the weaving operation without the use of ancillary means, thereby preventing the two fabrics from slipping. In the case of a loden or loden-like material in the upper fabric, the properties of the lower fabric must also be adapted to ensure that the loss in the length of the fabric occurring during the fulling of the loden causes no corrugation or arching. Fulling gives the wool fabric a characteristic felted structure, while the cotton fabric merely shrinks to a certain degree.

Preferably, the ratio between the number of one thread and the number of the other thread or threads varies, being preferably 2:1. As a result the density and the associated properties of the upper and lower fabrics can be influenced in a controlled manner.

The problem of producing a fabric whose upper side consists mainly of one thread and whose lower side consists mainly of the other thread or threads is solved by the features that the fabric is produced in a single weaving operation, the warp threads being formed exclusively by one thread and the weft threads being formed exclusively by the other thread or threads. Even though it is only a single fabric consisting of at least two different threads, the visual effect of a double fabric can be achieved by a skillful selection of the weaving technique.

Figure 1A:
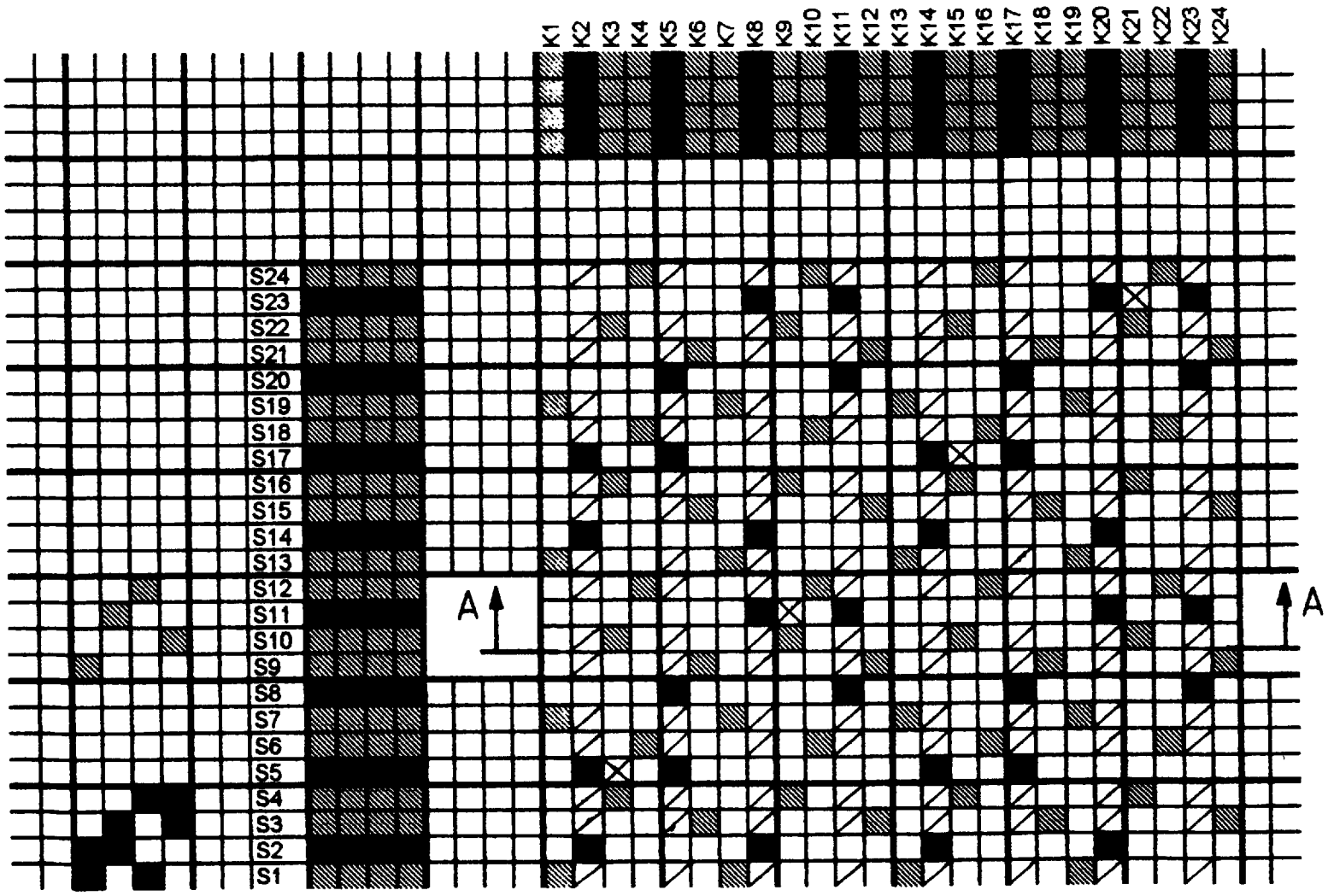
Figure 1B:
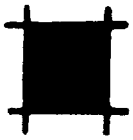
Figure 1C:
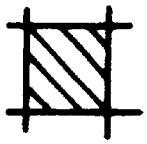
Figure 1D:
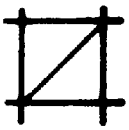
Figure 1E:
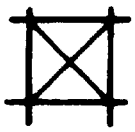
Figure 1F:
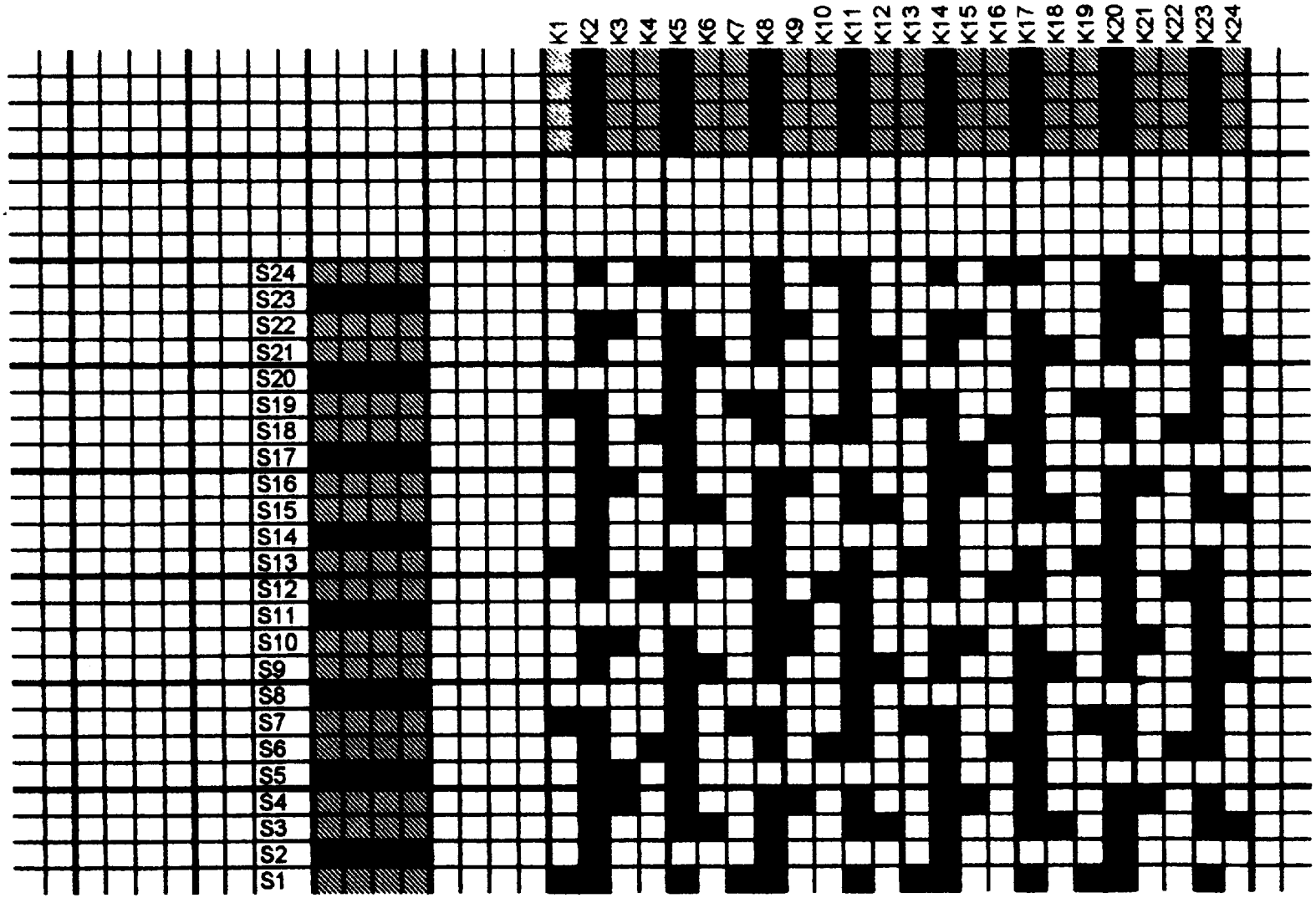

The advantages of the fabrics and production method according to the invention will now be explained in greater detail with reference to the annexed drawings, which show:

FIG. 1—a diagrammatic sectional illustration of a double fabric,

FIG. 1*a*—the basic structure of a fabric according to the invention, consisting of an upper fabric and a lower fabric connected thereto, FIGS. 1*b–e*—the explanations of the symbols used in the drawings, FIG. 1*f*—the weaver's instructions for producing the fabric shown in FIG. 1*a,*

Figure 1G:
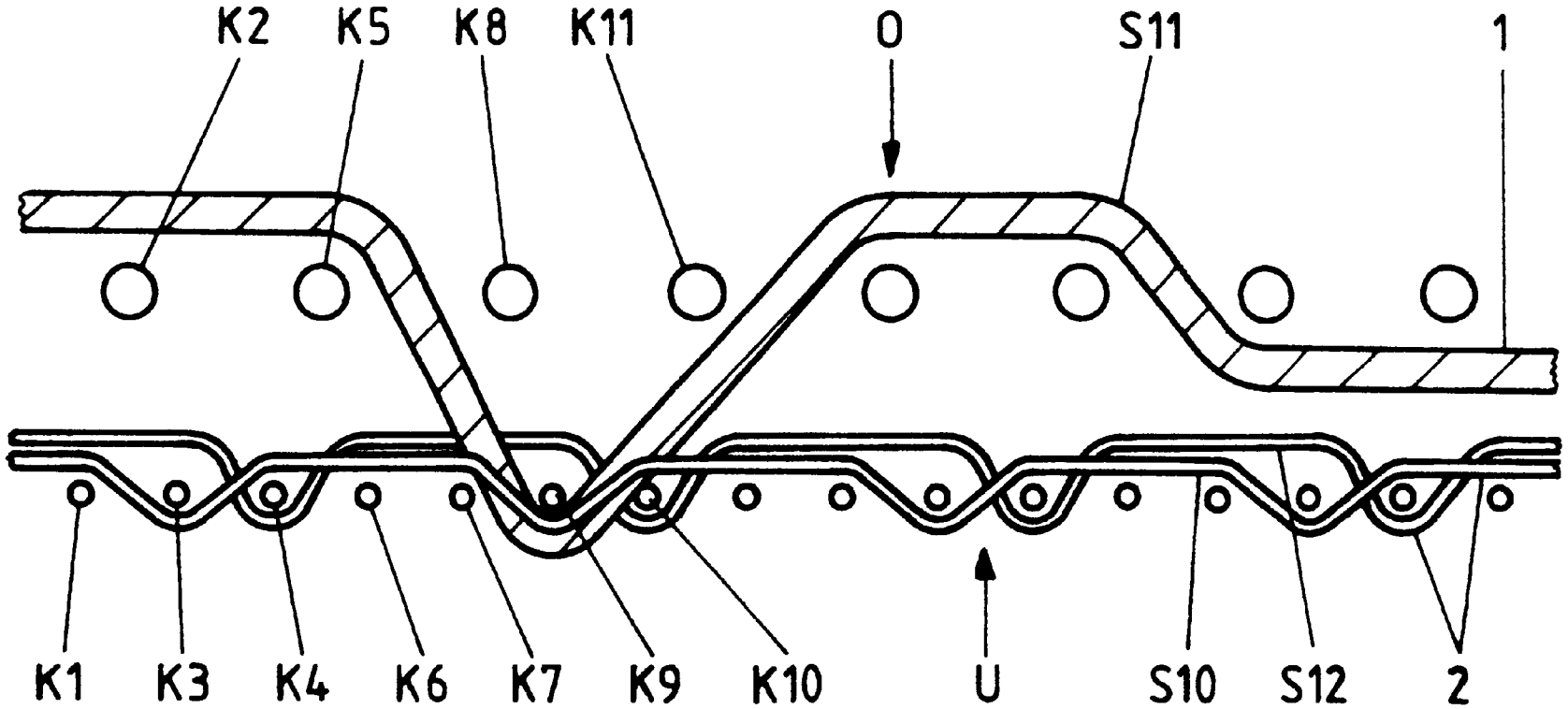
Figure 2A:
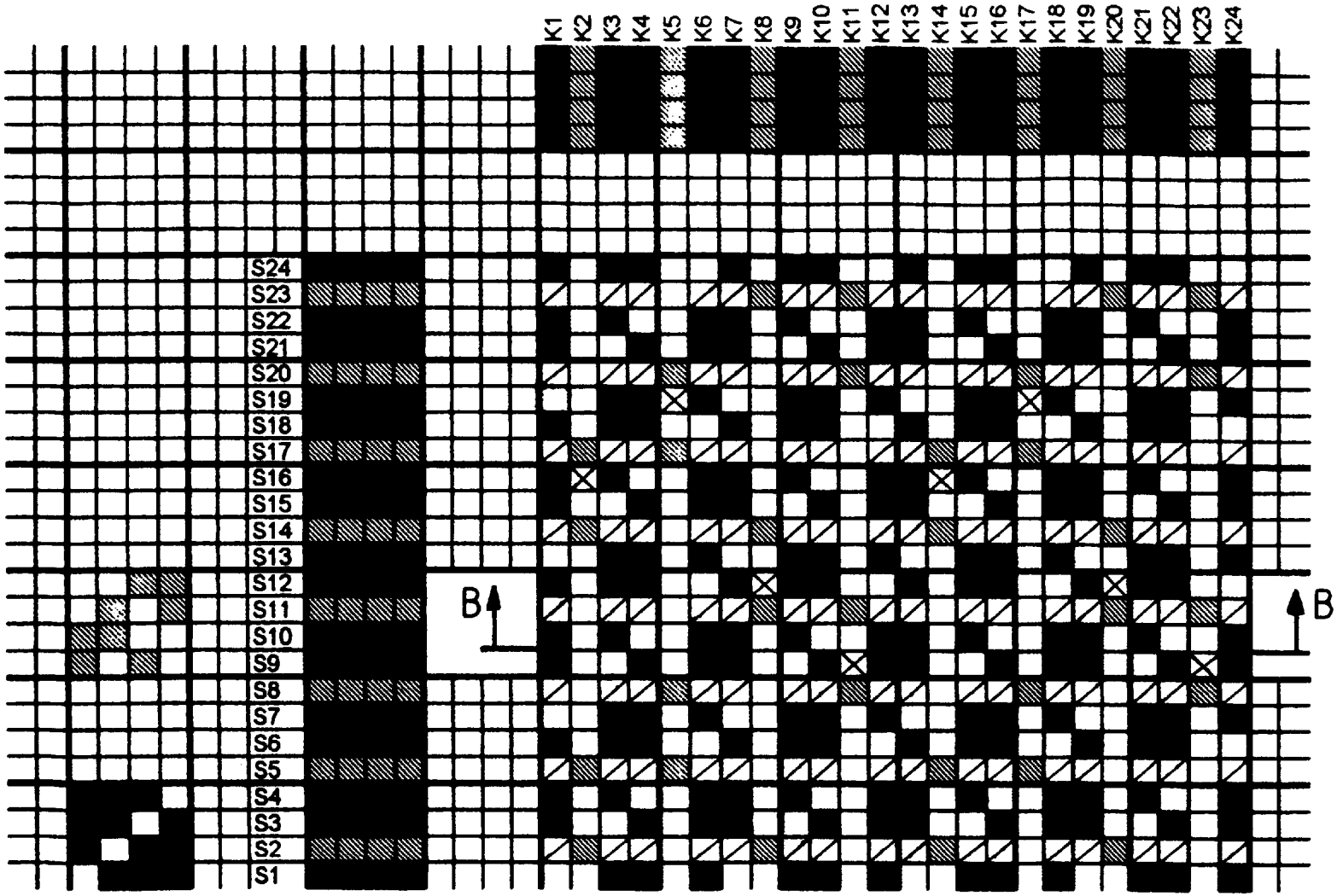
Figure 2B:
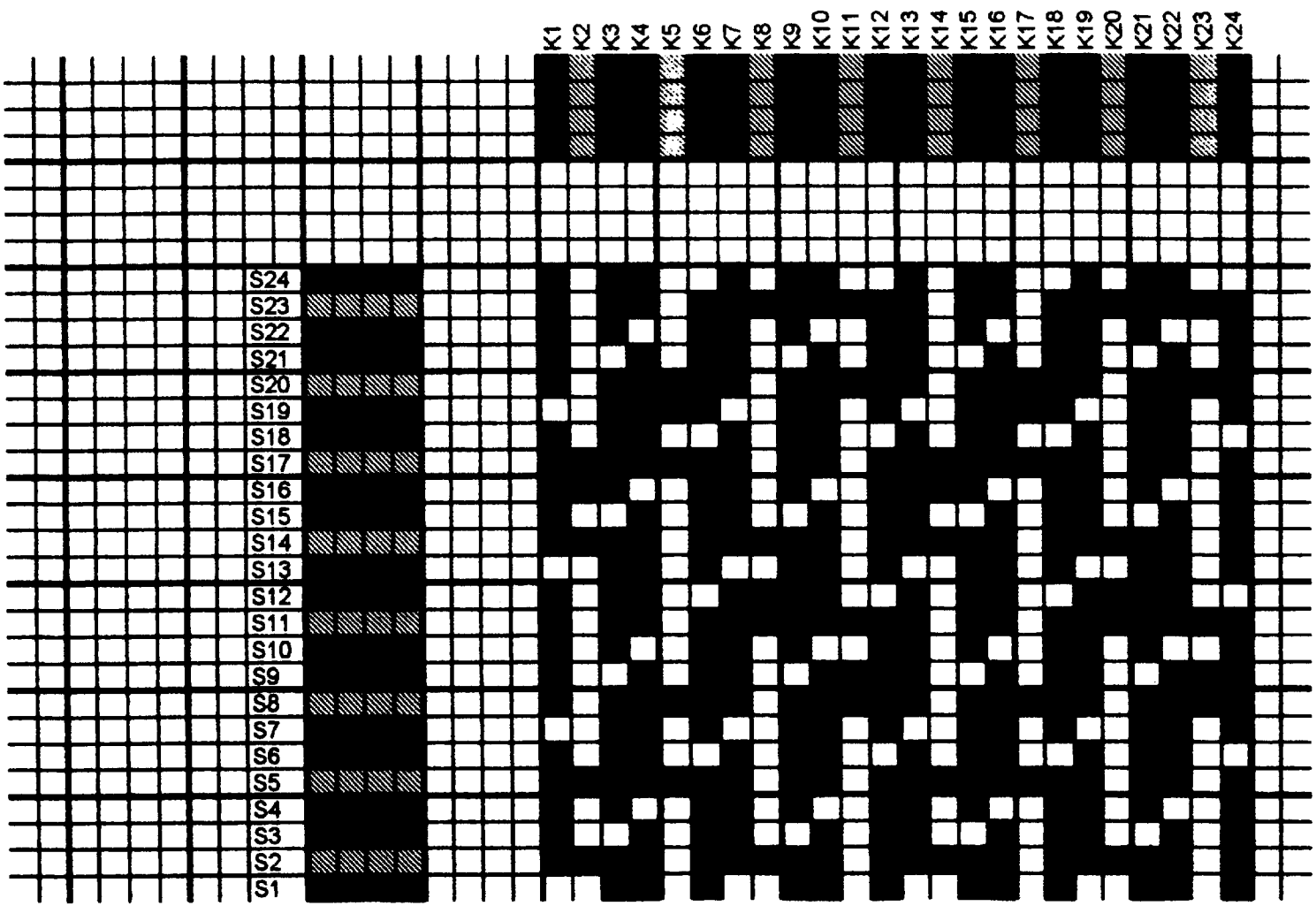

FIG. 1*g*—a sectional illustration of the fabric shown in FIG. 1*a*, taken along the line A—A, FIG. 2*a*—a variant of the fabric according to the invention, comprising an upper fabric and a lower fabric connected thereto, FIG. 2*b*—the weaver's instructions for producing the fabric shown in FIG. 2*a,*

Figure 3A:
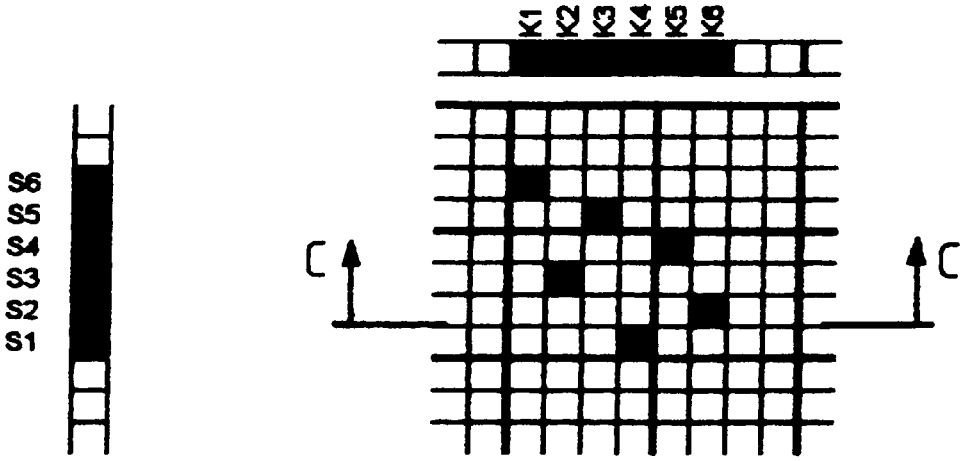
Figure 3B:
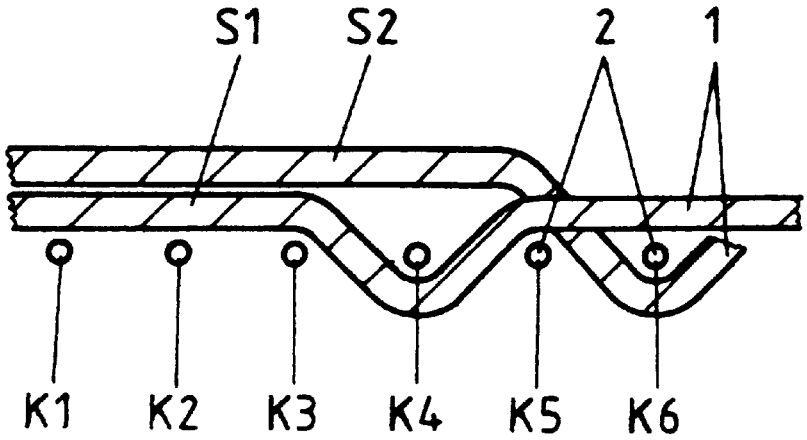
Figure 2C:
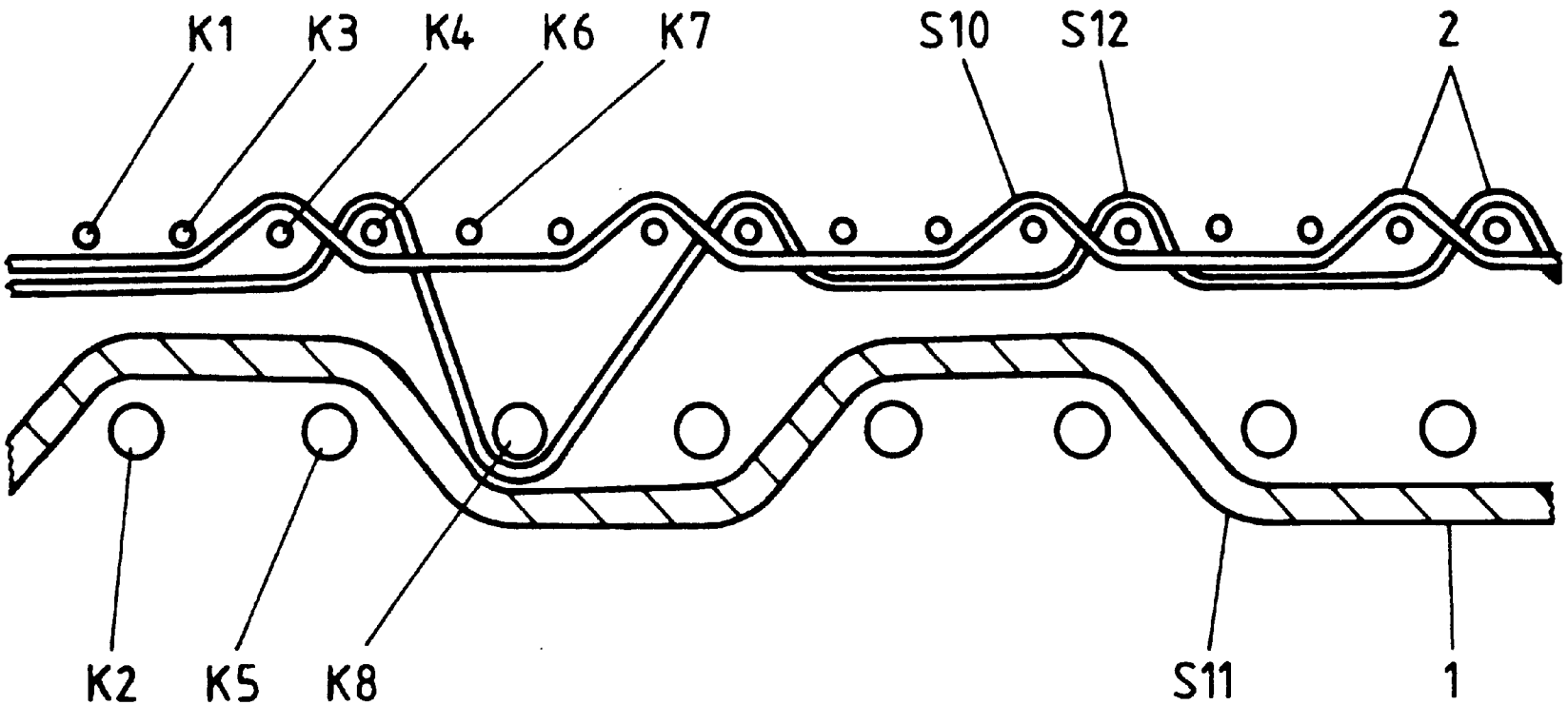

FIG. 2*c*—a sectional illustration of the fabric shown in FIG. 2*a*, taken along the line B—B, FIG. 3*a*—the weaver's instructions for a fabric according to the invention, whose upper side consists mainly of one thread and whose lower side consists mainly of the other thread, and FIG. 3*b*—a sectional illustration of the fabric shown in FIG. 3*a*, taken along the line C—C.

FIG. 1 shows the cross-section of a fabric, showing how an appropriate weaving technique makes possible the visual design of the fabric, with two different sides of different fabrics and therefore of a different nature. The cut threads represent the warp threads K and the transversely extending threads represent the weft threads S. In the sectional illustration the upper weft threads S and the upper warp threads K consist of cotton threads 2, and the lower weft threads S and the lower warp threads K consist of wool threads 1. A double fabric consisting of an upper fabric O and a lower fabric U results.

FIG. 1*a* shows the construction of a fabric according to the invention, comprising an upper fabric and a lower fabric connected thereto. With reference to the corresponding symbols shown in FIGS. 1*b–e*, the drawing shows the interpenetration of the warp threads K and weft threads S and the steps taken to produce two separate layers of fabric, which are connected to one another only at certain places. The symbol FIG. 1*b* denotes the weaving technique for the upper fabric. The symbol FIG. 1*c* shows the weaving technique for the lower fabric. The symbol FIG. 1*d* characterises the points of intersection between the upper warp threads and the lower weft thread. In general, the upper warp thread must be raised above the lower weft thread to produce two separate layers of fabric. The symbol "X" according to FIG. 1*e* characterises many points of intersection below the lower warp thread and the upper weft thread. In this case the lower warp thread is raised over the upper weft thread to produce a woven connection between the upper fabric and the lower fabric.

The weaver's (point paper design) instructions show the pattern in the fabric weave. The drawing shows the particular positions of the warp threads and weft threads during the weaving operation. The instructions shown in FIG. 1*f* apply to 24×24 threads. This part of the weave is repeated in accordance with the size of the material to be woven. The positions of the warp threads K1 to K24 are shown on the upper, horizontal part of the instructions. According to these instructions the warp threads are formed alternately by a wool thread 1 for the upper fabric and two cotton threads 2 for the lower fabric. During the weaving operation the weft threads are drawn in between the warp threads. The weft threads S1 to S24 are shown on the left-hand vertical side of the instructions. They are also formed alternately by a wool thread 1 for the upper fabric and two cotton threads 2 for the lower fabric. The black squares indicate a raising of the warp thread and also a lowering of the weft thread at that place, while the white squares indicate a raising of the weft thread and a lowering of the warp thread at that place. At the places indicated by "X" in FIG. 1*a* the upper fabric is connected according to the invention to the lower fabric by the connection of a cotton thread 2 to a wool thread 1. Corresponding to the first line of the weaving instructions, all the wool threads 1 and also four cotton threads 2 are raised and a cotton thread 2 is "shot-in" (picked). In the next weaving step, in accordance with the second line of the weaving instructions, four selected wool threads 1 are raised and a wool thread 1 is "shot-in", and also a cotton thread 2 is connected to the shot-in wool thread 1 at the place marked by "X" in FIG. 1*a*. The weaving operation is continued correspondingly; in known manner the weft threads consisting of wool threads 1 come to lie above the weft threads consisting of cotton threads 2. According to the invention, at each "shot" (pick) of a cotton thread 2, all the wool threads 1 and also a certain number of cotton threads 2 are raised. As a result the separation of the two fabrics is effected—i.e. the upper web consisting of the wool threads 1 is formed on one side and the lower web, consisting of the cotton threads 2 is formed on the other side of the web according to the invention, and they are connected to one another at individual places "X". In the instructions shown, the connection between the fabrics is made at diagonally disposed points "X". In addition to such a diagonal weave, the connecting points can also be differently disposed. One variant, for example, would be a so-called satin-type tying of the lower fabric to the upper fabric. In the case of a loden the fabric according to the invention is subjected after weaving to a fulling process, as a result of which the material shrinks and the side of the woollen fabric acquires the characteristic appearance of a loden. Due to the smooth structure of cotton, the cotton fabric cannot acquire a loden-like appearance. During fulling care must be taken to ensure that the two fabrics do not undergo individual shrinkage, since otherwise the fabric would arch up or folds might form, something which might make further processing of the material difficult or impossible. The connection between the woollen fabric and the cotton fabric is not visible from the side of the woollen fabric. As a result, from the side of the woollen fabric the fabric according to the invention looks like a conventional loden, although according to the invention a second fabric, in this case a cotton fabric, is connected to the loden. When the cotton fabric is viewed, the diagonally disposed connecting points can be detected as a diagonal structure. Due to the cotton fabric, for example, the wearing properties of the loden can be appreciably enhanced, since the cotton fabric is smoother than loden and therefore more pleasant to wear. The properties can be further influenced by a suitable selection of the thickness and number of the wool and cotton threads. For example, the density of the cotton fabric can be increased so that no threads or parts of threads of the loden can penetrate through the cotton fabric, thereby possibly adversely affecting the smooth structure.

FIG. 1*g* shows section A—A in FIG. 1*a*, at a place in the fabric at which the upper fabric O is connected to the lower fabric U, so that the connecting points are not visible on the upper side of the goods. The drawing shows the weft threads S10 and S12 consisting of cotton threads 2 and also the weft thread S11, consisting of a wool thread 1. The connection between the upper fabric O and the lower fabric U, which is effected via the weft thread S11 and the warp thread K9 visible from the lower side of the goods.

FIGS. 2*a* and 2*b* are similar to FIGS. 1*a* and 1*f*, but relate to a fabric in which the weft of the upper fabric is connected to the lower fabric so that the thread of the upper fabric remains visible in the lower fabric.

FIG. 2*c* is a section through the fabric shown in FIG. 2*a*, taken along the line B—B. According to the instructions shown in FIG. 2*a*, the twelfth weft thread S12, consisting of a cotton thread 2, is connected to the eighth warp thread K8, consisting of a wool thread 1, as shown in the drawing, so that the connection is covered by the weft thread S11 and is therefore invisible from the side of the fabric.

FIG. 3*a* shows the weaver's instructions for a fabric according to the invention which consists of at least two different threads 1, 2 and whose upper side is mainly formed from one thread 1, its lower side being mainly formed from the other thread 2 or threads 2. It has a ratio of 6×6 threads. This part of the weave is repeated in accordance with the size of the material to be woven. In the fabric shown in FIG. 3*a* all the warp threads K1 to K6 consist of one material, in this case cotton 2, and all the weft threads S1 to S6 consist of the other material, in this case wool 1. This suitable selection of the weaving technique produces the effect that at least 90%, preferably 99.3% of the wool threads 1 come to lie on the upper side of the fabric, and at least 90%, preferably 99.3% of the cotton threads 2 on the lower side of the fabric.

FIG. 3*b* shows a cross-section through a fabric as shown in FIG. 3*a*, the warp threads K1 to K6 consisting of one material, in this case cotton threads 2, while all the weft threads S1 to S6 consist of wool threads 1.

The weaving techniques illustrated are merely examples of the production of a fabric according to the invention. Other weaving techniques are of course also conceivable within the scope of the invention.

What is claimed is:

1. A fabric for the production of clothing from at least two different threads, characterised in that the fabric consists of an upper fabric and a lower fabric, the upper fabric being formed exclusively from one thread and the lower fabric exclusively from the other thread or threads, while the upper fabric is connected to the lower fabric by attachment of individual threads of the lower fabric to threads of the side of the upper fabric adjacent the lower fabric, and further being characterised in that the upper side of the fabric is formed essentially from one thread and the lower side of the fabric is formed essentially from the other thread or threads, and further being characterised in that the threads consist of different materials.

2. A fabric according to claim 1, characterised in that the upper side of the fabric consists of at least 90% of one thread and the lower side of the fabric consists of 90% of the other thread or threads.

3. A fabric according to claim 1, characterised in that the threads have different colours.

4. A fabric according to claim 1, characterised in that the threads have different thicknesses.

5. A fabric according to claim 1, characterised in that one thread consists essentially of wool and the other thread or threads consist essentially of cotton.

6. A fabric according to claim 5, characterised in that the upper fabric the fabric formed by the wool thread is an unfulled wool cloth (loden) fabric.

7. A fabric according to claim 1, characterised in that the lower fabric of the fabric is denser than the upper fabric/the upper side of the fabric.

8. A method of producing a fabric according to claim 1, characterised in that the fabric is woven and produced in a single weaving operation from at least two different threads.

9. A method according to claim 8, characterised in that the ratio between the number of one thread and the number of the other thread or threads varies.

10. A method of producing a fabric for the production of clothing from at least two different threads, characterised in that the fabric consists of an upper fabric and a lower fabric, the upper fabric being formed exclusively from one thread and the lower fabric exclusively from the other thread or threads, while the upper fabric is connected to the lower fabric by attachment of individual threads of the lower fabric to threads of the side of the upper fabric adjacent the lower fabric, and further being characterised in that the upper side of the fabric is formed essentially from one thread and the lower side of the fabric is formed essentially from the other thread or threads characterised in that the fabric is produced in a single weaving operation, the warp threads being formed exclusively by one thread and the weft threads being formed exclusively by the other thread or threads.

11. A fabric according to claim 1, characterised in that the upper side of the fabric consists of at least 99.3% of one thread and the lower side of the fabric consists of 99.3% of the other thread or threads.

12. A method according to claim 9, characterised in that the ratio is 2:1.

13. A woven fabric for the production of clothing from at least two different threads, characterised in that the fabric consists of an upper fabric and a lower fabric, the upper fabric being formed exclusively from one thread and the lower fabric exclusively from the other thread or threads, while the upper fabric is connected to the lower fabric by attachment of individual threads of the lower fabric to threads of the side of the upper fabric adjacent the lower fabric in a single weaving operation, and further being characterised in that the upper side of the fabric is formed essentially from one thread and the lower side of the fabric is formed essentially from the other thread or threads, and further being characterised in that the upper side of the fabric consists of at least 90% of one thread and the lower side of the fabric consists of 90% of the other thread or threads, and further being characterised in that one thread consists essentially of wool and the other thread or threads consist essentially of cotton.

14. A fabric according to claim 13, characterised in that the upper fabric of the fabric formed by the wool thread is an unfulled wool cloth (loden) or a loden-like fabric.

15. A woven fabric for the production of clothing from at least two different threads, characterised in that the fabric consists of an upper fabric and a lower fabric, the upper fabric being formed exclusively from one thread and the lower fabric exclusively from the other thread or threads, while the upper fabric is connected to the lower fabric by attachment of individual threads of the lower fabric to threads of the side of the upper fabric adjacent the lower fabric so that the fabric when viewed from one side has the visual appearance of a substantially homogeneous fabric, and further being characterised in that the upper side of the fabric is formed essentially from one thread and the lower side of the fabric is formed essentially from the other thread or threads, and further being characterised in that the upper side of the fabric consists of at least 90% of one thread and the lower side of the fabric consists of 90% of the other thread or threads, and further being characterised in that one thread consists essentially of wool and the other thread or threads consist essentially of cotton.

16. A fabric according to claim 15, characterised in that the upper fabric of the fabric formed by the wool thread is an unfulled wool cloth (loden) or a loden-like fabric.

* * * * *